US010210988B2

(12) United States Patent
Kawasaki et al.

(10) Patent No.: US 10,210,988 B2
(45) **Date of Patent: *Feb. 19, 2019**

(54) COIL COMPONENT

(71) Applicant: TDK Corporation, Tokyo (JP)

(72) Inventors: Yoshihiro Kawasaki, Tokyo (JP); Syun Ashizawa, Tokyo (JP); Hirohumi Asou, Tokyo (JP); Nobuo Takagi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/426,390

(22) Filed: Feb. 7, 2017

(65) Prior Publication Data

US 2017/0229229 A1 Aug. 10, 2017

(30) Foreign Application Priority Data

Feb. 9, 2016 (JP) ..... 2016-022358

(51) Int. Cl.
*H01F 27/29* (2006.01)
*H01F 27/255* (2006.01)
*H01F 27/28* (2006.01)
*H01F 3/10* (2006.01)

(52) U.S. Cl.
CPC ..... *H01F 27/255* (2013.01); *H01F 3/10* (2013.01); *H01F 27/2823* (2013.01); *H01F 27/2828* (2013.01); *H01F 27/292* (2013.01)

(58) Field of Classification Search
CPC ..... H01F 27/255; H01F 27/2828; H01F 3/10; H01F 27/2823; H01F 27/292
USPC ..... 336/192, 83, 233
See application file for complete search history.

(56) References Cited

U.S. PATENT DOCUMENTS 6,348,850 B1 * 2/2002 Kimura ..... H01F 17/045 336/200
7,932,803 B2 * 4/2011 Hirai ..... H01F 17/045 29/602.1
2003/0071704 A1 * 4/2003 Toi ..... H01F 17/045 336/83
2005/0115628 A1 * 6/2005 Sasaki ..... H01F 41/066 140/92.1

(Continued)

FOREIGN PATENT DOCUMENTS

JP H09-219318 A 8/1997
JP 2003-209010 A 7/2003
JP 2004-363178 A 12/2004

*Primary Examiner* — Elvin G Enad
*Assistant Examiner* — Kazi Hossain
(74) *Attorney, Agent, or Firm* — Young Law Firm, P.C.

(57) ABSTRACT

Disclosed herein is a coil component that includes a drum core having a winding core and first and second flange portions provided at opposite ends of the winding core; a wire wound around the winding core; terminal electrodes provided in the first and second flange portions, the terminal electrodes being connected to ends of the wire; and a magnetic top plate made of magnetic-powder containing resin in which magnetic powder is mixed in binder resin, the magnetic top plate being fixed to the first and second flange portions. The magnetic top plate has a lower surface facing the first and second flange portions and an upper surface located opposite to the lower surface. The density of the binder resin is higher in a surface layer part on a side of the lower surface than in a surface layer part on a side of the upper surface.

7 Claims, 5 Drawing Sheets

(56) References Cited

U.S. PATENT DOCUMENTS

| | | | | |
|---|---|---|---|---|
| 2010/0099365 | A1 | 4/2010 | Aramaki et al. | |
| 2010/0321144 | A1* | 12/2010 | Kudo | H01F 17/045 336/192 |
| 2012/0068798 | A1* | 3/2012 | Lauder | G06F 1/1613 335/306 |

* cited by examiner

COIL COMPONENT

BACKGROUND OF THE INVENTION

Field of the Invention

The present invention relates to a coil component, and more particularly relates to a coil component using a drum core.

Description of Related Art

A coil component using a drum core can be surface-mounted on a printed circuit board differently from a coil component using a toroidal core, and thus has been widely used for mobile electronic devices such as a smartphone. Further, because the coil component using a drum core has a low height, it also contributes to thinning of mobile electronic devices.

However, in recent years, further thinning of mobile electronic devices has been desired, and in order to realize this, a further lower height has been desired for the coil component using a drum core. As one method of realizing a low height of a coil component, a method in which a magnetic top plate generally bonded to a drum core is omitted can be considered. However, in this case, because leakage of the magnetic flux increases, other circuits such as an antenna may be adversely affected. Meanwhile, because a magnetic top plate made of ferrite is fragile, if the thickness thereof is reduced, its strength becomes insufficient, and thus the magnetic top plate may be broken at the time of assembly or at the time of actual use.

To solve the above problems, it suffices to use magnetic-powder containing resin having flexibility instead of using ferrite as a material of the magnetic top plate. The magnetic-powder containing resin can maintain certain strength even if it is thinned. Therefore, by using the magnetic-powder containing resin as the material of the magnetic top plate, leakage of the magnetic flux can be suppressed while realizing a low height. As an example of using magnetic-powder containing resin as a material of a magnetic top plate, coil components described in Japanese Patent Application Laid-open No. H9-219318 and Japanese Patent Application Laid-open No. 2004-363178 can be mentioned.

Magnetic-powder containing resin can be produced by applying a mixed solution in which magnetic powder is mixed in binder resin to a base material such as abase film. However, in the mixed solution applied to the base film, distribution of the binder resin and the magnetic powder is not uniform, and a region containing binder resin in high density and a region containing magnetic powder in high density may be generated depending on the conditions. Particularly, a surface layer part on the base film side and a surface layer part on the opposite side thereof may contain the binder resin and the magnetic powder in different densities from each other.

In this manner, because the front and back sides of a magnetic top plate made of magnetic-powder containing resin may have different characteristics from each other, at the time of bonding the magnetic top plate to a drum core, the obtained characteristics and functions may differ according to which side of the magnetic top plate is bonded to the drum core.

SUMMARY

Therefore, it is an object of the present invention to provide a coil component capable of obtaining a desired function in a case where the front and back sides of a magnetic top plate made of magnetic-powder containing resin have different characteristics from each other.

A coil component according to the present invention includes a drum core having a winding core and first and second flange portions provided at opposite ends of the winding core, wires wound around the winding core, terminal electrodes respectively provided in the first and second flange portions and connected with ends of the wires, and a magnetic top plate made of magnetic-powder containing resin in which magnetic powder is mixed in binder resin, being fixed to the first and second flange portions, wherein the magnetic top plate has a lower surface facing the first and second flange portions and an upper surface located opposite to the lower surface, and the density of the binder resin is higher in a surface layer part on the side of the lower surface than in a surface layer part on the side of the upper surface.

According to the present invention, because the density of the binder resin is high in the surface layer part on the side of the lower surface of the magnetic top plate, impact resistance of the drum core is increased by the magnetic top plate. Consequently, a coil component having high reliability can be obtained.

In the coil component according to the present invention, it is preferable to further include an adhesive that bonds the first and second flange portions with the lower surface of the magnetic top plate. The adhesive and the binder resin respectively have a linear expansion coefficient relatively approximate to each other. Therefore, peeling of the magnetic top plate due to a temperature change hardly occurs.

In the present invention, it is preferable that each of the first and second flange portions includes an upper surface covered with the magnetic top plate, a mounting surface located opposite to the upper surface, and outer side surface vertical to the upper surface and the mounting surface, the terminal electrodes are continuously formed on the upper surface, the mounting surface, and the outer side surface, and the ends of the wires are respectively connected to the terminal electrodes formed on the upper surface. Accordingly, because a flat mounting surface is obtained, mounting stability is improved. Further, even if the terminal electrodes are provided in the first and second flange portions respectively in plural, because the density of the binder resin is high in the surface layer part on the side of the lower surface of the magnetic top plate, insulation resistance between the adjacent terminal electrodes can be ensured sufficiently.

Alternatively, it is also preferable that each of the first and second flange portions includes an upper surface covered with the magnetic top plate, a mounting surface located opposite to the upper surface, and outer side surface vertical to the upper surface and the mounting surface, the terminal electrodes are continuously formed on the mounting surface and the outer side surface, and the ends of the wires are respectively connected to the terminal electrodes formed on the mounting surface. Accordingly, because the upper surfaces of the flange portions become flat, a gap between the flange portion and the magnetic top plate can be narrowed.

In the present invention, it is preferable that the magnetic powder is soft magnetic metal powder. Accordingly, high magnetic properties can be obtained. Particularly, it is preferable that the soft magnetic metal powder has a flat shape. Accordingly, higher magnetic properties can be obtained.

According to the present invention, when front and back sides of a magnetic top plate made of soft magnetic metal powder have different characteristics from each other, a coil component in which impact resistance of the drum core is increased can be provided.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1:
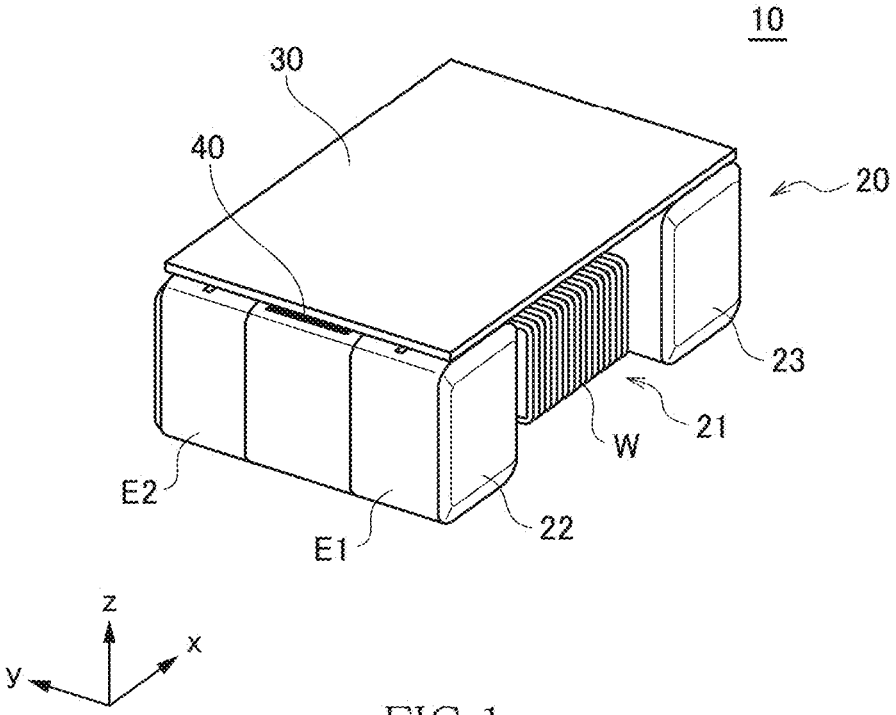
FIG. 1 is a perspective view of a coil component according to a preferred embodiment of the present invention when an upper surface thereof is viewed from an oblique direction.
Figure 2:
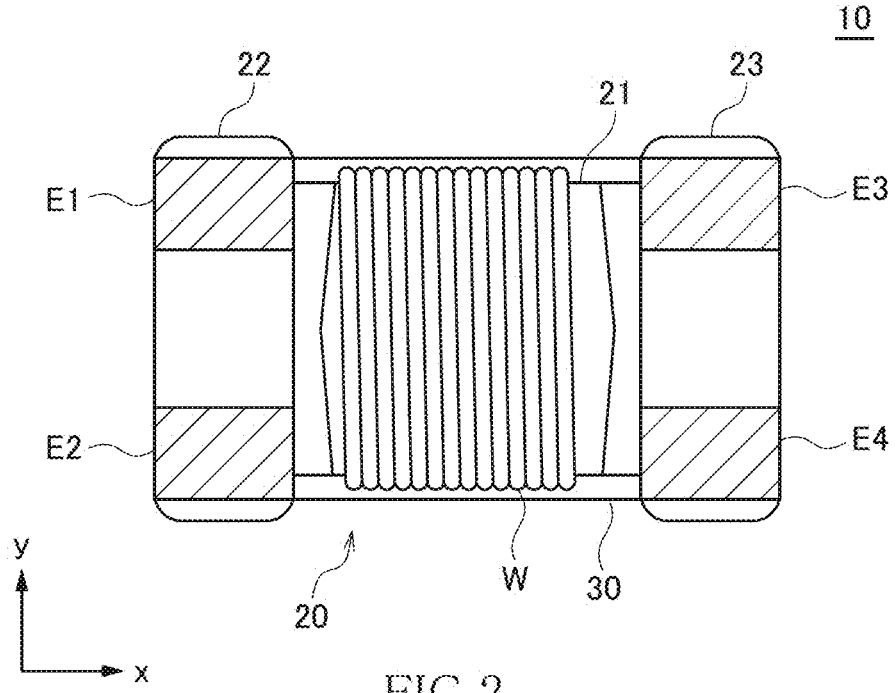
FIG. 2 is a plan view of the coil component according to the preferred embodiment of the present invention as viewed from a mounting surface.

FIG. 1 and FIG. 2 are diagrams showing an appearance of a coil component 10 according to a preferred embodiment of the present invention. FIG. 1 is a perspective view of the coil component when an upper surface thereof is viewed from an oblique direction, and FIG. 2 is a plan view thereof as viewed from a mounting surface.

As shown in FIG. 1 and FIG. 2, the coil component 10 according to the present embodiment includes a drum core 20 and a magnetic top plate 30. The drum core 20 has a winding core 21 with an x direction being an axial direction, and first and second flange portions 22 and 23 provided at opposite ends of the winding core 21 in the x direction. The drum core 20 is made of a ceramic material having high magnetic permeability such as ferrite, and has a configuration in which the winding core 21 and the flange portions 22 and 23 are integrally formed.

Two wires W are wound around the winding core 21, and opposite ends of these wires W are respectively connected to terminal electrodes E1 to E4 provided in the flange portions 22 and 23. In the present embodiment, the terminal electrodes E1 and E2 are formed in one flange portion 22, and the terminal electrodes E3 and E4 are formed in the other flange portion 23. The terminal electrodes E1 to E4 are formed continuously on an xy plane of the flange portions 22 and 23 constituting a mounting surface, an xy plane of the flange portions 22 and 23 located opposite to the mounting surface and constituting an upper surface, and yz planes of the flange portions 22 and 23 constituting outer side surfaces. In the present embodiment, the wires W are respectively connected to the terminal electrodes E1 to E4 provided on the upper surfaces of the flange portions 22 and 23; however, the wires W can be connected to the terminal electrodes E1 to E4 provided on the mounting surfaces of the flange portions 22 and 23. In this case, the terminal electrodes E1 to E4 do not need to be provided on the upper surfaces of the flange portions 22 and 23.

The application of the coil component 10 according to the present embodiment is not particularly limited to any type, and can be a general-purpose coil component for inductance, or can be a coil component for a specific application, for example, for a common-mode filter, for a pulse transformer, or for a balun transformer. Therefore, the number of wires W wound around the winding core 21, the number of windings, the winding direction, and the winding method are not particularly limited to any specific number. The size of the coil component 10 is not particularly limited to any specific size. However, the length in the x direction is about 1.6 millimeters, the width in a y direction is about 1.0 millimeter, and the height in a z direction is from about 0.55 millimeter to about 0.65 millimeter.

As shown in FIG. 1, the magnetic top plate 30 is fixed on the xy plane constituting the upper surfaces of the flange portions 22 and 23 via an adhesive 40. The magnetic top plate 30 is made of magnetic-powder containing resin obtained by mixing magnetic powder in binder resin, and has higher magnetic permeability than general resin. Because the magnetic top plate 30 is fixed on the upper surfaces of the flange portions 22 and 23 so as to span the wiring core 21, the drum core 20 and the magnetic top plate 30 constitute a closed magnetic path. Therefore, as compared to a case where a top plate made of only resin is used, leakage of the magnetic flux decreases, and magnetic impact on other circuits, for example, on an antenna circuit can be reduced. Further, the magnetic top plate 30 is also used as an adsorption face for handling at the time of mounting on a printed circuit board.

As described above, the magnetic-powder containing resin constituting the magnetic top plate 30 is obtained by mixing magnetic powder in binder resin. The binder resin preferably has a cross-linked structure by urethane bond, with acrylic ester copolymer being a main chain. Meanwhile, it is preferable to use soft magnetic metal powder having a flat shape for the magnetic powder. When soft magnetic metal powder having a flat shape is used, it is preferable to mix the soft magnetic metal powder in the binder resin so that a principal plane of the soft magnetic metal powder becomes the xy plane. Accordingly, the magnetic permeability in the x direction, being a direction of the magnetic flux passing the magnetic top plate 30, can be increased, and the soft magnetic metal powder having a flat shape also functions as an electromagnetic shield.

Figure 3:
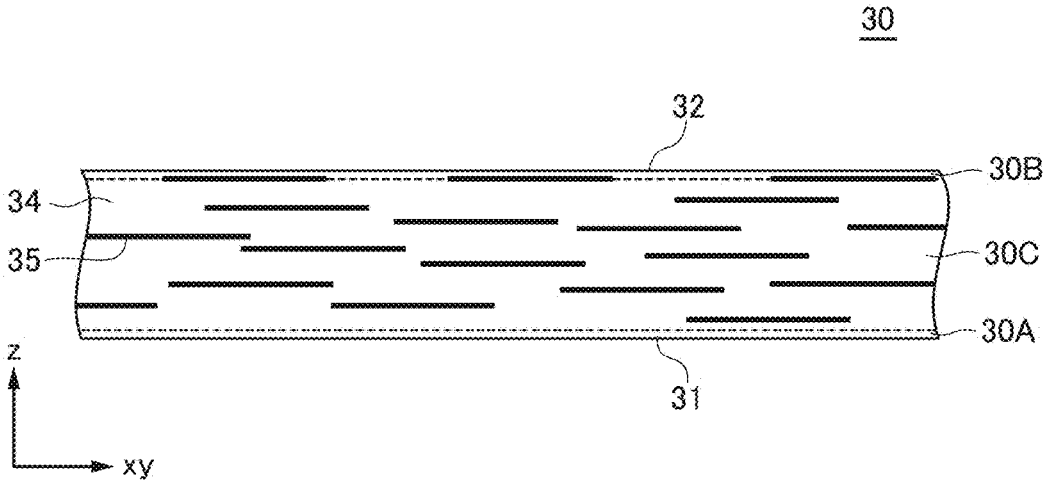
FIG. 3 is an explanatory schematic sectional view of the structure of a magnetic top plate.

FIG. 3 is an explanatory schematic sectional view of the structure of the magnetic top plate 30.

As shown in FIG. 3, the magnetic top plate 30 has a lower surface 31 bonded to the flange portions 22 and 23 and an upper surface 32 located opposite to the lower surface 31. In the magnetic top plate 30, distribution of the binder resin and the magnetic powder in the thickness direction (the z direction) is not completely uniform, and particularly, a surface layer part 30A on the side of the lower surface 31 and a surface layer part 30B on the side of the upper surface 32 have different characteristics from each other.

Specifically, in an inner layer part 30C of the magnetic top plate 30, the soft magnetic metal powder 35 is distributed substantially uniformly in the binder resin 34. Meanwhile, in the surface layer part 30A on the side of the lower surface 31, the density of the magnetic powder 35 is lower than that in the inner layer part 30C, and the density of the binder resin 34 is higher than that in the inner layer part 30C. As a result, there is less magnetic powder 35 exposed on the lower surface 31, and typically, the magnetic powder 35 is hardly exposed on the lower surface 31. In this case, substantially the entire surface of the lower surface 31 is covered with the binder resin 34. On the other hand, in the surface layer part 30B on the side of the upper surface 32, the density of the magnetic powder 35 is substantially identical to that in the inner layer part 30C. That is, in the surface layer part 30B on the side of the upper surface 32, the density of the magnetic powder 35 in the binder resin 34 is substantially the same as that in the inner layer part 30C. Therefore, the magnetic powder may be exposed to some extent from the upper surface 32.

Figure 4:
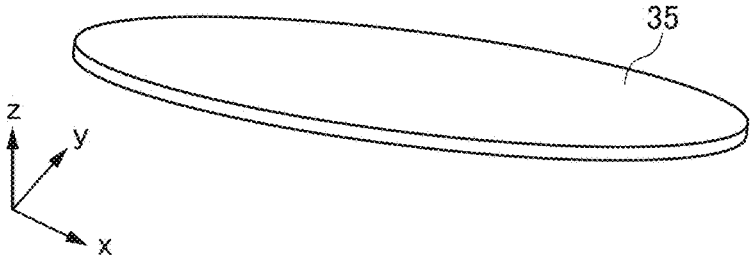
FIG. 4 is an explanatory schematic diagram of the shape of a magnetic powder contained in the magnetic top plate.

FIG. 4 is an explanatory schematic diagram of the shape of the magnetic powder 35 contained in the magnetic top plate 30.

The magnetic powder 35 shown in FIG. 4 is soft magnetic metal powder having a flat shape and has a shape being flat in the xy direction. The magnetic powder 35 shown in FIG. 4 has a shape in which the x direction thereof is a longitudinal direction; however, the shape of the magnetic powder 35 is not limited thereto. In this manner, if soft magnetic metal powder being flat in the xy direction is used as the magnetic powder 35, high magnetic permeability can be obtained in the x direction, which is the direction of the magnetic flux passing the magnetic top plate 30.

Figure 5A:
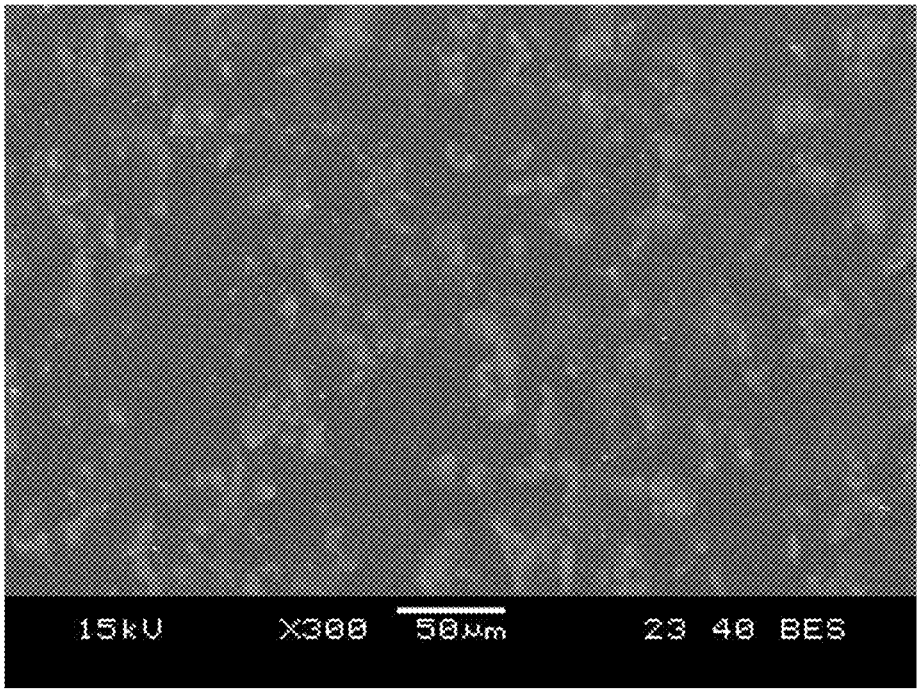
FIG. 5A is an electron micrographs of a lower surface the magnetic top plate.
Figure 5B:
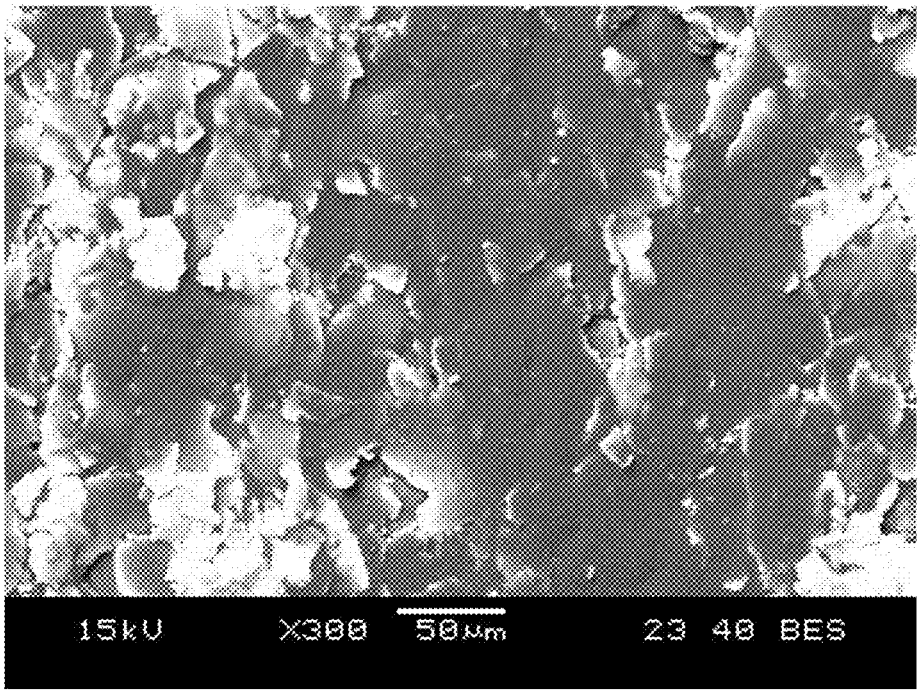
FIG. 5B is an electron micrographs of an upper surface the magnetic top plate.

FIGS. 5A and 5B are electron micrographs of the magnetic top plate 30 actually manufactured, wherein FIG. 5A is a photograph of the lower surface 31, and FIG. 5B is a photograph of the upper surface 32. In these photographs, a dark portion is the binder resin 34, and a white portion is the magnetic powder 35.

As shown in FIG. 5A, it is understood that, in the surface layer part 30A on the side of the lower surface 31, the density of the magnetic powder 35 is low and the density of the binder resin 34 is high, and thus when the magnetic top plate 30 is shot by the electron microscope, it is shot dark across the board. Particularly, there is hardly any magnetic powder 35 exposed on the lower surface 31. On the other hand, as shown in FIG. 5B, it is understood that in the surface layer part 30B on the side of the upper surface 32, the density of the magnetic powder 35 is high and the density of the binder resin 34 is low, and thus when the magnetic top plate 30 is shot by an electron microscope, a large amount of the magnetic powder 35 is shot white. It is also understood that a large amount of the magnetic powder 35 is exposed on the upper surface 32.

In this manner, the magnetic top plate 30 has such a feature that the density of the binder resin 34 is higher in the surface layer part 30A on the side of the lower surface 31 than in the surface layer part 30B on the side of the upper surface 32. A manufacturing process of the magnetic top plate 30 described later can cause such a difference to be generated between the surface layer parts 30A and 30B.

While it is not particularly limited thereto, the thickness of the magnetic top plate 30 in the z direction is preferably equal to or less than 100 micrometers, more preferably equal to or less than 75 micrometers, and particularly preferably about 60 micrometers. If the thickness of the magnetic top plate 30 is equal to or less than 100 micrometers, the height of the entire coil component 10 in the z direction can be set low. When the thickness of the magnetic top plate is reduced to 100 micrometers or less while using ferrite, the magnetic top plate may be broken due to insufficient strength. However, if the magnetic top plate 30 in which the magnetic powder 35 is mixed in the binder resin 34 is used, even if the thickness is reduced to 100 micrometers or less, there will be no breakage. While the lower limit of the thickness of the magnetic top plate 30 is not particularly limited to any size, it is preferable that the lower limit is equal to or higher than 30 micrometers. This is because if the thickness of the magnetic top plate 30 is reduced to less than 30 micrometers, the strength is not sufficient, and it is difficult to ensure sufficient magnetic properties. To suppress leakage of the magnetic flux sufficiently, it is preferable that the magnetic permeability of the magnetic top plate 30 is equal to or higher than 30.

Predetermined flexibility, heat resistance, and strength are required for the binder resin to be used for the magnetic top plate 30. The reason the flexibility and the strength are required is that even if the thickness of the magnetic top plate 30 is reduced, for example, to 100 micrometers or less, there will be no breakage. The reason the heat resistance is required is that there will be no deformation at the time of reflow. Therefore, a material having high strength but low flexibility, and a material having high flexibility but low heat resistance are not appropriate. Because the reflow temperature is about 260° C., at least binder resin that is not deformed at that temperature needs to be used.

Taking these points into consideration, in the present embodiment, binder resin having a cross-linked structure by urethane bond, with acrylic ester copolymer being a main chain is used. Regarding the composition, although not particularly limited thereto, the acrylic ester copolymer preferably has at least a copolymer structure of ethyl acrylate and a copolymer structure of butyl acrylate. This is for adding the flexibility by the copolymer structure of butyl acrylate, while ensuring high strength by the copolymer structure of ethyl acrylate. It is also preferable that the acrylic ester copolymer further has a copolymer structure of acrylonitrile. This is because the heat resistance and strength are increased by containing the copolymer structure of acrylonitrile.

The magnetic top plate 30 can be manufactured according to the following method. First, a binder solution in which a solute containing ethyl acrylate, butyl acrylate, and acrylonitrile having a hydroxyl group or a carboxyl group as a functional group is a main monomer is dissolved in an organic solvent such as methyl ethyl ketone is prepared. A mixed solution is prepared by mixing magnetic powder and a curing agent in the binder solution. As the curing agent, it is preferable to use isocyanate. As the isocyanate, for example, it is preferable to use, for example, aromatic isocyanate or isocyanate containing a triazine ring in the structure, and more preferably, containing a plurality of isocyanate groups in one molecule. Accordingly, the hydroxyl group or the carboxyl group contained as the functional group in the acrylic ester copolymer reacts with isocyanate to form the cross-linked structure. Further, a filler other than the magnetic powder, for example, talc or mica can be further mixed therein.

Figure 6:
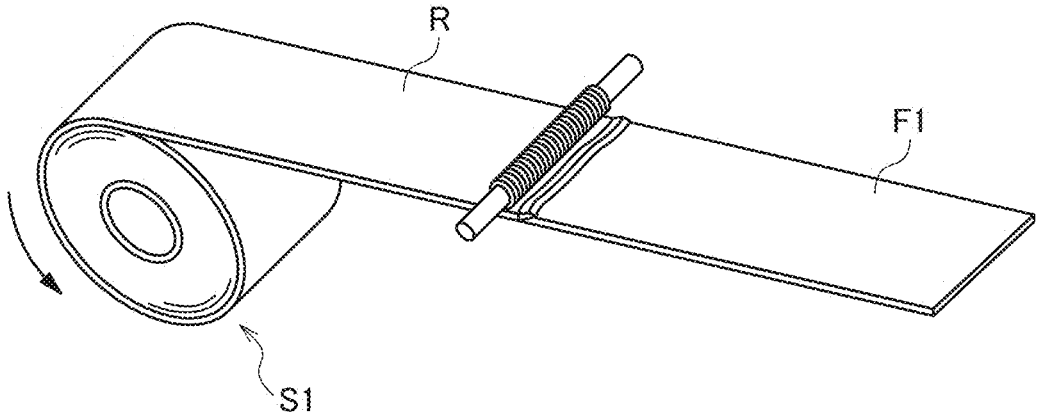
FIG. 6 is an explanatory schematic diagram for explaining a manufacturing method of a sheet in which a magnetic-powder containing resin is coated on a base film.

As shown in FIG. 6, the mixed solution is applied onto a base film F1, the base film F1 is then wound around a roll while heating the base film F1 to dry the solvent in the mixed solution and cure the binder resin. The magnetic powder can be oriented in a predetermined direction by applying magnetic field at the time of applying the mixed solution onto the base film F1. Accordingly, a sheet S1 in which magnetic-powder containing resin R is applied onto the surface of the base film F1 is obtained. As the base film F1, a PET film can be used. It is preferable that a content ratio of the magnetic powder in the cured magnetic-powder containing resin is from 50% to 90% by weight. If the content ratio of the magnetic powder is less than 50% by weight, sufficient magnetic permeability cannot be obtained, and if the content ratio thereof exceeds 90% by weight, the possibility that the magnetic powder falls off from a cut surface of the magnetic top plate 30 increases.

When the magnetic-powder containing resin R is applied onto the surface of the base film F1, characteristics of the magnetic-powder containing resin R are slightly different in the surface layer part on the base film F1 side and in the surface layer part on an exposed side opposite thereto. It is considered this is due to the surface tension of the binder resin, which is uncured. The density of the magnetic powder 35 becomes low in the surface layer part on the base film F1 side and becomes high in the surface layer part on the exposed side.

The base film F1 is peeled off from the sheet S1, the front and back sides of the magnetic-powder containing resin R is inverted and stuck to another base film, thereby preparing a sheet S2. Accordingly, the surface of the magnetic-powder containing resin R, which has been a lower side (on the side of the base film F1) when applied to the base film F1 becomes an exposed side.

Figure 7A:
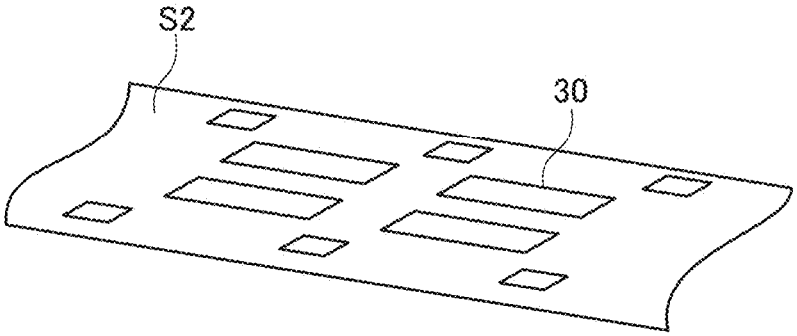
FIGS. 7A to 7C are process diagrams for explaining a manufacturing method of the coil component.
Figure 7B:
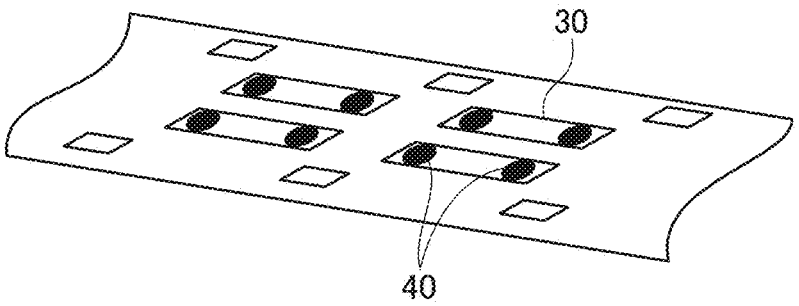
Figure 7C:
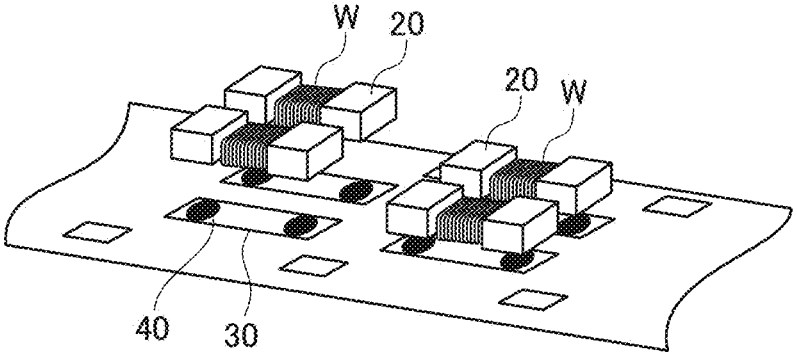

Subsequently, as shown in FIG. 7A, the sheet S2 is punched in a planar shape of the magnetic top plate 30 by a mold. Next, as shown in FIG. 7B, an epoxy adhesive 40 is applied to a punched portion, and as shown in FIG. 7C, a drum core 20 wound with the wire W is bonded thereto. The drum core 20 bonded with the magnetic top plate 30 is separated from the sheet body, and the base film is peeled off, thereby completing the coil component 10 according to the present embodiment.

By preparing the coil component 10 according to such method, the magnetic top plate 30 can be bonded to the drum core 20, in such a manner that the surface of the magnetic-powder containing resin R, which has faced the base film F1 side at the time of application, that is, the surface of the magnetic top plate 30 on the side in which the density of the binder resin 34 is high is set as the lower surface 31.

Accordingly, resilience in the surface layer part 30A on the side of the lower surface 31 increases. Therefore, even if a physical impact is applied to the magnetic top plate 30, the impact applied to the drum core 20 is absorbed to some extent, thereby increasing impact resistance of the coil component 10. Further, the adhesive 40 comes in contact with the surface layer part 30A in which the density of the binder resin 34 is high. Because both the adhesive 40 and the surface layer part 30A respectively have a linear expansion coefficient approximate to each other, peeling of the magnetic top plate 30 due to a temperature change hardly occurs. Furthermore, because the magnetic powder 35 is hardly exposed on the lower surface 31 of the magnetic top plate 30, insulation resistance between adjacent terminal electrodes, for example, between the terminal electrode E1 and the terminal electrode E2 can be ensured sufficiently.

It is apparent that the present invention is not limited to the above embodiments, but may be modified and changed without departing from the scope and spirit of the invention.

What is claimed is:

1. A coil component comprising:

a drum core having a winding core and first and second flange portions provided at opposite ends of the winding core;

a wire wound around the winding core;

terminal electrodes provided in the first and second flange portions, the terminal electrodes being connected to ends of the wire; and a magnetic top plate made of magnetic-powder containing resin in which magnetic powder is mixed in binder resin, the magnetic top plate being fixed to the first and second flange portions, wherein the magnetic top plate has a lower surface facing the first and second flange portions and an upper surface located opposite to the lower surface, and wherein the density of the binder resin is higher in a surface layer part on a side of the lower surface than in a surface layer part on a side of the upper surface.

2. The coil component as claimed in claim 1 further comprising an adhesive that bonds the first and second flange portions with the lower surface of the magnetic top plate.

3. The coil component as claimed in claim 1, wherein each of the first and second flange portions includes an upper surface covered with the magnetic top plate, a mounting surface located opposite to the upper surface, and outer side surface substantially vertical to the upper surface and the mounting surface, wherein the terminal electrodes are continuously formed on the upper surface, the mounting surface, and the outer side surface, and wherein the ends of the wire are respectively connected to the terminal electrodes formed on the upper surface.

4. The coil component as claimed in claim 3, wherein a plurality of the terminal electrodes are formed on each of the first and second flange portions.

5. The coil component as claimed in claim 1, wherein each of the first and second flange portions includes an upper surface covered with the magnetic top plate, amounting surface located opposite to the upper surface, and outer side surface substantially vertical to the upper surface and the mounting surface, wherein the terminal electrodes are continuously formed on the mounting surface and the outer side surface, and wherein the ends of the wire are respectively connected to the terminal electrodes formed on the mounting surface.

6. The coil component as claimed in claim 1, wherein the magnetic powder is soft magnetic metal powder.

7. The coil component as claimed in claim 6, wherein the soft magnetic metal powder has a flat shape.

* * * * *